US005406968A

United States Patent [19]

Friedman et al.

[11] Patent Number: 5,406,968

[45] Date of Patent: Apr. 18, 1995

[54] COLLAPSIBLE UMBRELLA

[76] Inventors: John S. Friedman, 19 Lanbert R., Sharon, Conn. 06069; Michael A. Cousins, 330 E. 33rd St., New York, N.Y. 10012

[21] Appl. No.: 219,788

[22] Filed: Mar. 30, 1994

[51] Int. Cl.[6] ..... A45B 3/00

[52] U.S. Cl. ..... 135/16; 135/19; 135/34.2; 135/33.2

[58] Field of Search ..... 135/16, 19, 19.5, 25.4, 135/33.2, 88, 90, 95, 98, 99, 34.2

[56] References Cited

U.S. PATENT DOCUMENTS

| | | | |
|---|---|---|---|
| 782,744 | 2/1905 | Funk . | |
| 892,813 | 7/1908 | Dolles . | |
| 995,266 | 6/1911 | Lundberg . | |
| 1,058,928 | 4/1913 | Umstead . | |
| 1,217,515 | 2/1917 | Simon . | |
| 1,455,410 | 5/1923 | Posselt . | |
| 1,885,968 | 11/1932 | Wedemann . | |
| 1,964,292 | 6/1934 | Livingston . | |
| 2,091,676 | 8/1937 | Fliegner . | |
| 2,157,670 | 5/1939 | Ono . | |
| 2,177,458 | 10/1939 | Okun . | |
| 2,616,439 | 5/1949 | Thompson . | |
| 2,819,776 | 1/1958 | Balsam | 135/95 X |
| 2,853,086 | 9/1958 | Biagosch | 135/95 |
| 2,929,388 | 3/1960 | Norkin . | |
| 3,496,950 | 2/1970 | Weber . | |
| 3,902,514 | 9/1975 | Weber . | |
| 4,007,753 | 2/1977 | DeMarco . | |
| 4,077,421 | 3/1978 | Schultes . | |
| 4,105,039 | 8/1978 | Schultes . | |
| 4,420,007 | 12/1983 | Wu . | |
| 4,456,023 | 6/1984 | Fujihashi . | |
| 4,548,222 | 10/1985 | Day . | |
| 4,627,455 | 12/1986 | Okuda . | |
| 4,637,416 | 1/1987 | McFarlin | 135/95 |
| 4,658,844 | 4/1987 | Ping . | |
| 4,676,262 | 6/1987 | Yang . | |
| 4,682,617 | 7/1987 | Schultes . | |
| 4,821,756 | 4/1989 | England . | |

*Primary Examiner*—Lanna Mai
*Attorney, Agent, or Firm*—Amster, Rothstein & Ebenstein

[57] ABSTRACT

A collapsible umbrella includes a radiating frame including a plurality of telescoping ribs, an umbrella canopy having portions thereof respectively attached to the ribs of the frame, a folding sheathing assembly, and a centrally disposed telescoping stick. The folding sheathing assembly includes a plurality of panels hingedly connected to a central base member and a cover portion connected to one of the panels to cooperatively form a watertight enclosure for storing the canopy, frame and telescoping stick therein when situated in a storage orientation.

7 Claims, 5 Drawing Sheets

COLLAPSIBLE UMBRELLA

BACKGROUND

1. Field of Invention

The present invention relates to an umbrella, and more particularly, to a collapsible umbrella having a folding sheath assembly to store the umbrella in a fully collapsed condition when not in use.

2. Description of the Prior Art

Collapsible umbrellas permit the umbrella components to be folded into a relatively small package to facilitate ease of portability and storage when not in use.

One type is disclosed in U.S. Pat. No. 4,456,023 to Fujihashi, which comprises a central telescoping stick, a radiating folding frame slidably disposed on the telescoping stick, an umbrella canopy attached to the frame, and a tubular sheathing member which forms a handle on the bottom end of the stick. For storage, the frame and canopy are folded into a collapsed condition and the stick is partially retracted. The entire assembly is then inserted into the tubular sheathing member which is sealed to prevent moisture leakage from a wet umbrella canopy.

Another example of a collapsible umbrella is disclosed in U.S. Pat. No. 2,091,676 to Fliegner, which similarly comprises a telescoping stick, a radiating folding frame with an attached umbrella canopy, and a two-piece integral tubular sheath and handle assembly. Other similar structures can be found in U.S. Pat. Nos. 1,885,968 to Wedemann and 892,813 to Dolles.

All of these suffer from similar drawbacks in that the tubular sheathing member must be of a relatively large size to completely house the collapsed umbrella assembly. Moreover, the collapsing mechanisms employed in these umbrellas are relatively complex, which as a result, increases fabrication costs and reduces structural integrity.

SUMMARY OF THE INVENTION

In view of the aforementioned shortcomings of prior art collapsible umbrellas, it is an object of the present invention to provide a collapsible umbrella which incorporates a folding sheathing assembly to provide a compact, lightweight assembly for storage.

It is another object of the present invention to provide a collapsible umbrella having a radiating frame comprising a plurality of telescoping ribs to minimize the size of the collapsed frame assembly.

It is yet another object of the present invention to provide a collapsible umbrella where the sheathing assembly forms a watertight enclosure to eliminate moisture leakage from a wet umbrella canopy.

It is still another object of the invention to provide a collapsible umbrella which is economical to manufacture, easy to use and structurally durable.

In accordance with these and additional objects which will become apparent hereinbelow, in the preferred embodiment, the present invention provides a collapsible umbrella having a radiating frame comprised of a plurality of telescoping ribs, an umbrella canopy having portions thereof attached to the ribs of the frame, a folding sheathing assembly and a centrally disposed telescoping stick.

The folding sheathing assembly is comprised of a central base member and a plurality of panels hingedly connected to the base member and a cover hingedly connected to one of the panels, collectively forming the sides of a box-like enclosure when situated in a storage orientation. The panels and cover include cooperating interlocking provisions for providing a watertight seal between adjacent panels, the cover and the panels, and the panels and the base member. The interlocking provisions can be of the type wherein a continuous depression in the side of one panel receives a continuous hub from an adjacent panel in a snap-fit arrangement.

Each of the panels define an inner surface disposed to the interior of the box-like enclosure when situated in the storage orientation, and an outer surface. The telescoping ribs of the frame are disposed on the side of and attached to the inner surface of the panels. To prepare the umbrella for use, the sheathing assembly is opened by detaching the cover from the panels and the panels from each other such that the sheathing assembly forms the dome of the umbrella in a use orientation. The individual ribs may then be telescopically extended from a storage position, i.e., completely retracted, to a use position, i.e., completely extended, thereby spreading out the umbrella canopy about the frame.

The telescoping stick includes an integral handle portion to facilitate carrying the umbrella and is attached to the base member by way of a central core which forms a storage area for the stick. In this manner, the telescoping stick is stored within the core when the umbrella is not in use and the core is enclosed within the sheathing assembly such that there are no protrusions outside of the box-like enclosure during storage. When the umbrella is prepared for use, the telescopic stick may be fully extended.

DETAILED DESCRIPTION OF THE PREFERRED EMBODIMENT

Figure 1:
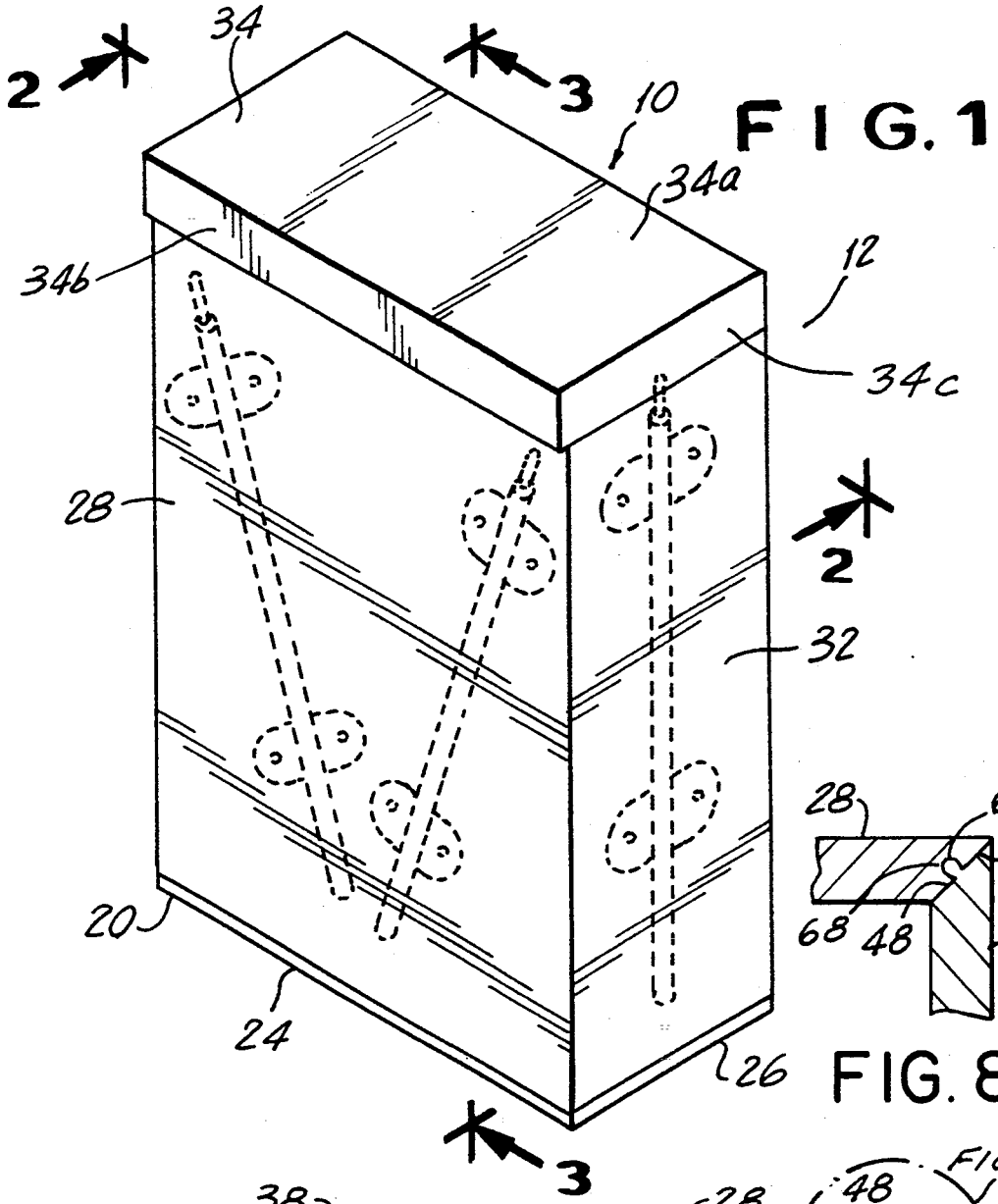
FIG. 1 is an isometric view of the folding sheath assembly in a storage orientation with the umbrella canopy and frame assembly fully collapsed.

With reference to the several views of the drawings, there is depicted a collapsible umbrella generally denoted by the reference numeral 10, comprised of an integral sheathing assembly and support structure 12, a telescoping stick 14, a radiating frame assembly 16 and an umbrella canopy 18.

As illustrated in FIGS. 1–6, sheathing assembly 12 comprises a central base member 20 having a central aperture 22 therethrough and a rectangular planform defined by two longer sides 24 and two shorter sides 26.

It is to be understood that central member 20 may be equally constructed with a square-shaped planform. The rectangular planform shown is merely exemplary and serves to support the configuration of the radiating frame assembly 16 of the illustrative embodiment. A pair of panels 28 are hingedly connected to base member 20 along respective opposing sides 24 by hinge elements 30. Similarily, a pair of panels 32 are hingedly connected to base member 20 along respective opposing sides 26 by hinge elements 33. The hinge elements may be selected from a variety of types of conventional hinge configurations known in the art. A cover portion 34 is hingedly connected to panel 28 by hinge element 30 as shown for purposes of illustration, but may be alternatively connected to any of the other panels. Cover portion 34 includes a lid section 34*a*, a front flange 34*b*, and opposing side flanges 34*c*. It is anticipated that in an exemplary embodiment, the overall dimensions of folded sheathing assembly 12 can be as small as approximately 3"×5"×1". The various panels and cover may be fabricated using conventional methods from a lightweight, moisture-impermeable plastic or the like.

Each panel 28 is defined by an inner face 36 and an outer face 38, a pair of elongated sides 40 and a top-side 42 opposite the side hinged to base member 20. Similarly, each panel 32 is defined by an inner face 44, an outer face 46, a pair of elongated sides 48 and a top side 50 opposite the side hinged to base member 20. As described above, cover portion 34 is hingedly connected by hinge element 30 to top-side 42 of one of the panels 28.

The radiating frame assembly 16 is comprised of a plurality of telescoping ribs 54 which may or may not be equally sized depending upon the desired configuration of umbrella canopy 18. Each rib 54 is defined by a first end 56 and a second end 58 where the first end 56 is movable relative to the second end 58 such that the rib can be collapsed to fit within sheathing assembly 12 when situated in the storage orientation shown in FIGS. 2 and 3. Ribs 54 are respectively attached to panels 28 and 32 with clip fasteners 60 against respective inner faces 36 and 44. It will be appreciated by persons skilled in the art that ribs 54 may be attached to the respective panels by any other equivalent means. The disclosed attachment method is intended as an example and should not be construed as limiting the scope of the appended claims. It is also anticipated that ribs 54 could be attached to an independent structure which is then enclosed by a separate sheathing assembly for storage. Alternatively, the ribs could be constructed in a plurality of folding sections which collapse to a length shorter than that of the panels in lieu of the telescoping construction shown and described.

Figure 5:
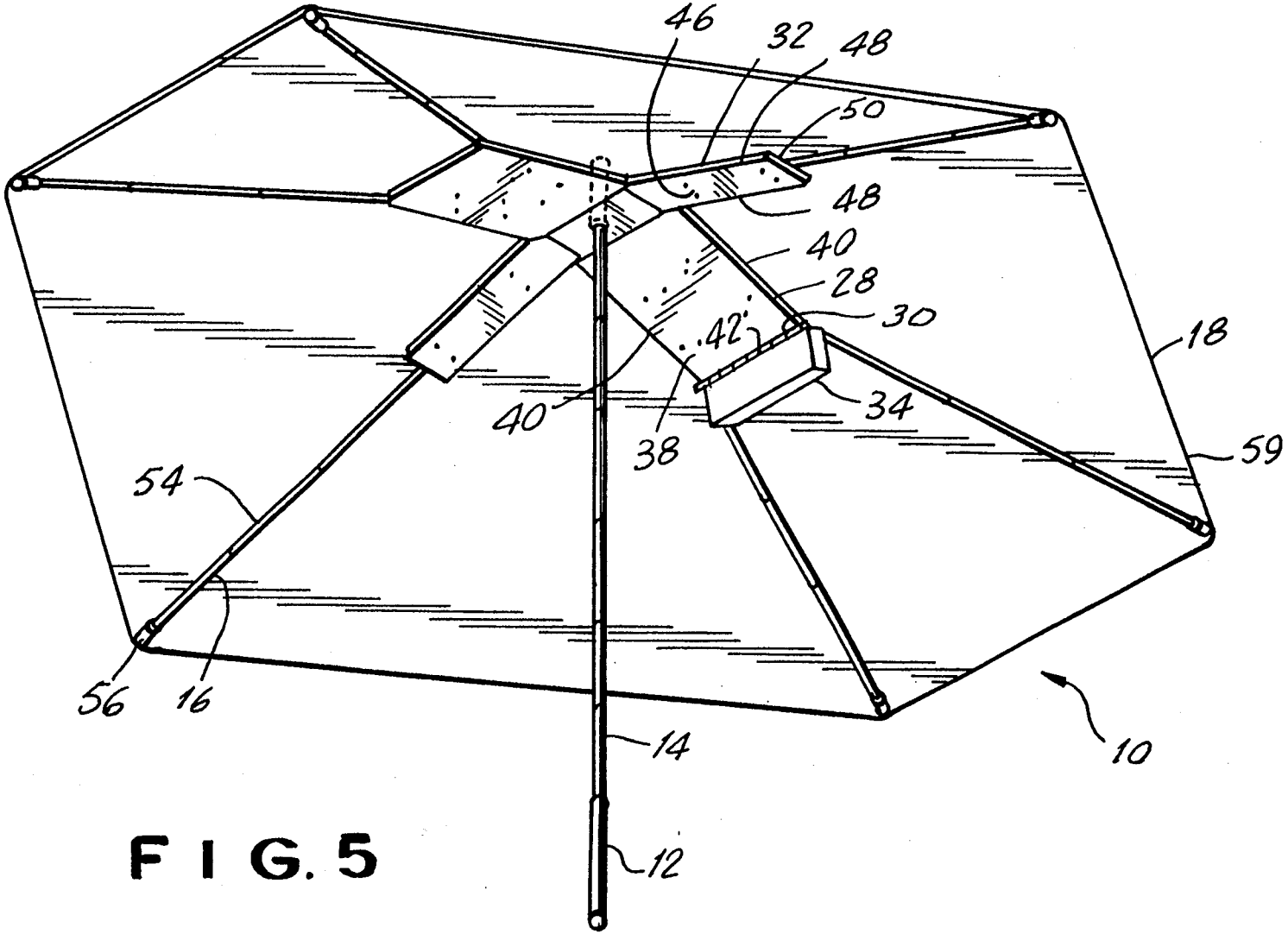
FIG. 5 is an isometric view of the umbrella viewed from beneath the canopy in a use orientation.
Figure 6:
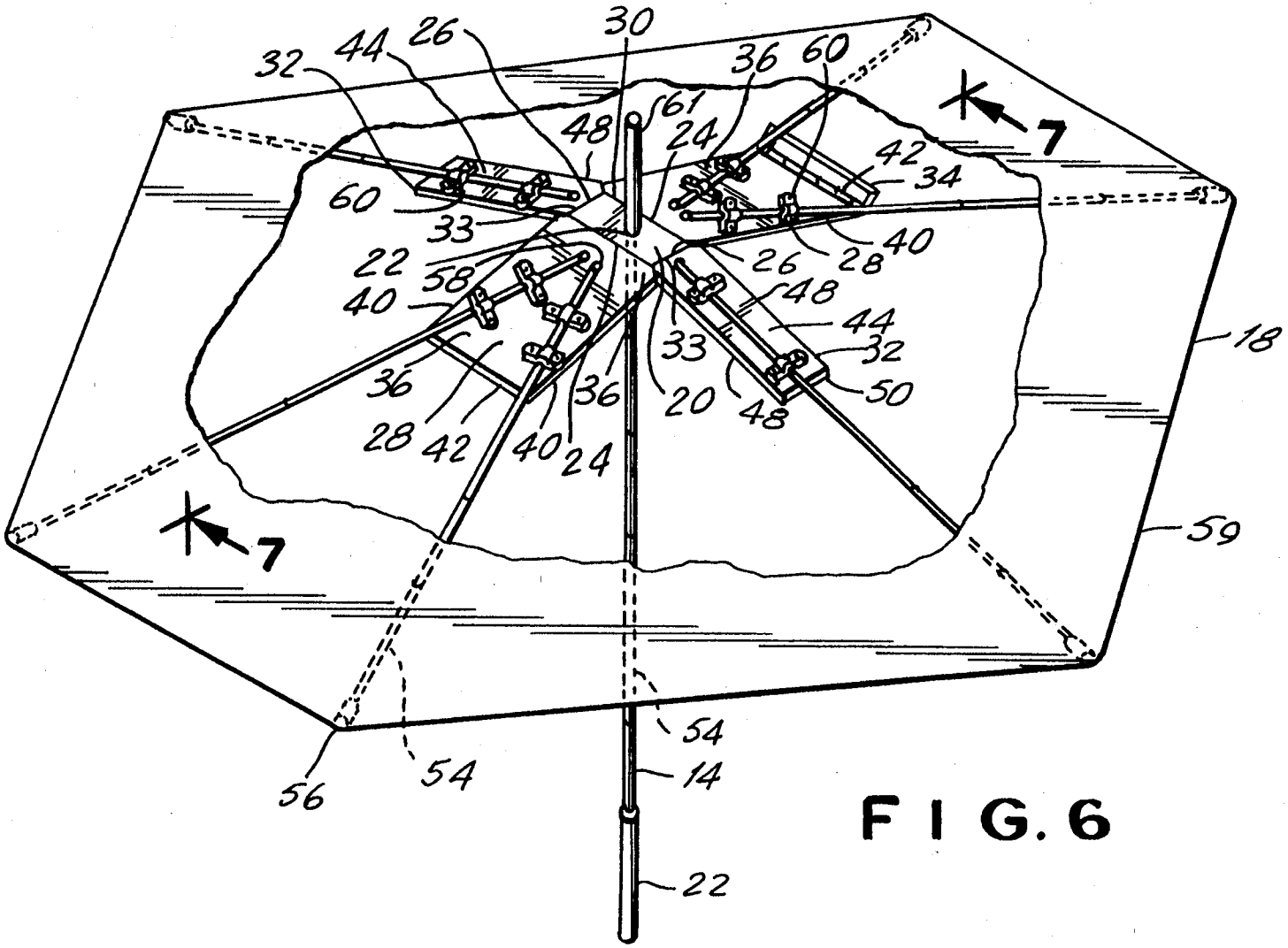
FIG. 6 is an isometric view of the umbrella viewed from above the canopy in a use orientation.

Referring now to FIGS. 5 and 6, umbrella canopy 18 is constructed from a fabric material in accordance with conventional manufacturing techniques in the desired pattern (such as the depicted six-sided shape). Umbrella canopy 18 defines a peripheral boundary 59 near which portions thereof are attached proximal to the respective first ends 56 of ribs 54. The center of umbrella canopy 18 includes an annular member 63 which forms a watertight seal around an elongated central core 61 for storing telescoping stick 14 therein when retracted into a storage position to prepare the umbrella for storage canopy 18 is folded by retracting each rib 54 into a storage position where the retracted rib has a length shorter than that of the supporting panel.

Figure 8:
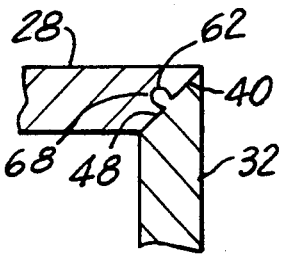
FIG. 8 is a detail of the sealed interface between panels of the folding sheath assembly.
Figure 4:
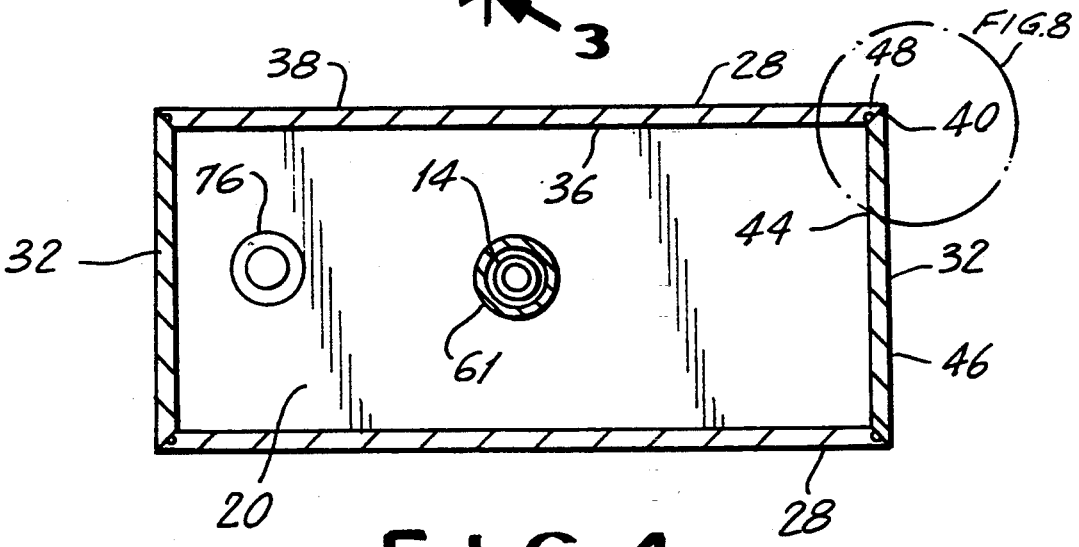
FIG. 4 is a section view along lines 4—4 in FIG. 2.

Referring now to FIGS. 2–4 and 7–9, it will be appreciated that in the exemplary embodiment, a watertight enclosure for a wet canopy 18 can be obtained by providing a series of cooperating interlocking provisions on mating sides of the sheathing panels. Specifically, each elongated side 40 of panel 28 includes a depression 62 which runs continuously along its length. A corresponding hub 64 integral with side 48 of panel 32 snap-fits into depression 62 to ensure a watertight seal between adjacent panels. Similarly, as shown in FIG. 8, panel 32 includes a continuous depression 64 which cooperates with a nub 66 along side 26 of base member 20. The same arrangement between panel 28 and side 24 of base member 20 and between cover 34 and panel 28 provides a seal between these mating parts. To ensure a watertight enclosure, contiguous nubs 68 between cover 34 and panels 28 and 32 near the respective top-sides 42 and 50 of panels 28 and 32 engage corresponding depressions 70 along the edges defined by front flange 34*b* and side flanges 34*c*. A flat seal 71 is provided between lid 34*a* and panel 28 adjacent the hinge element 30 joining these components. The choice of which panel has the depression and which panel has the nub is not critical and the depicted configuration is merely exemplary. Alternatively, a plurality of interlocking clips or the like can be provided on either the inner sides or outer sides of the panels to facilitate locking adjacent panels to each other in the storage orientation and it is further contemplated that alternative means for providing a watertight seal by utilizing other types of hinges and sealing provisions (e.g., a living hinge) could be implemented within the scope of the invention.

Figures 2, 7:
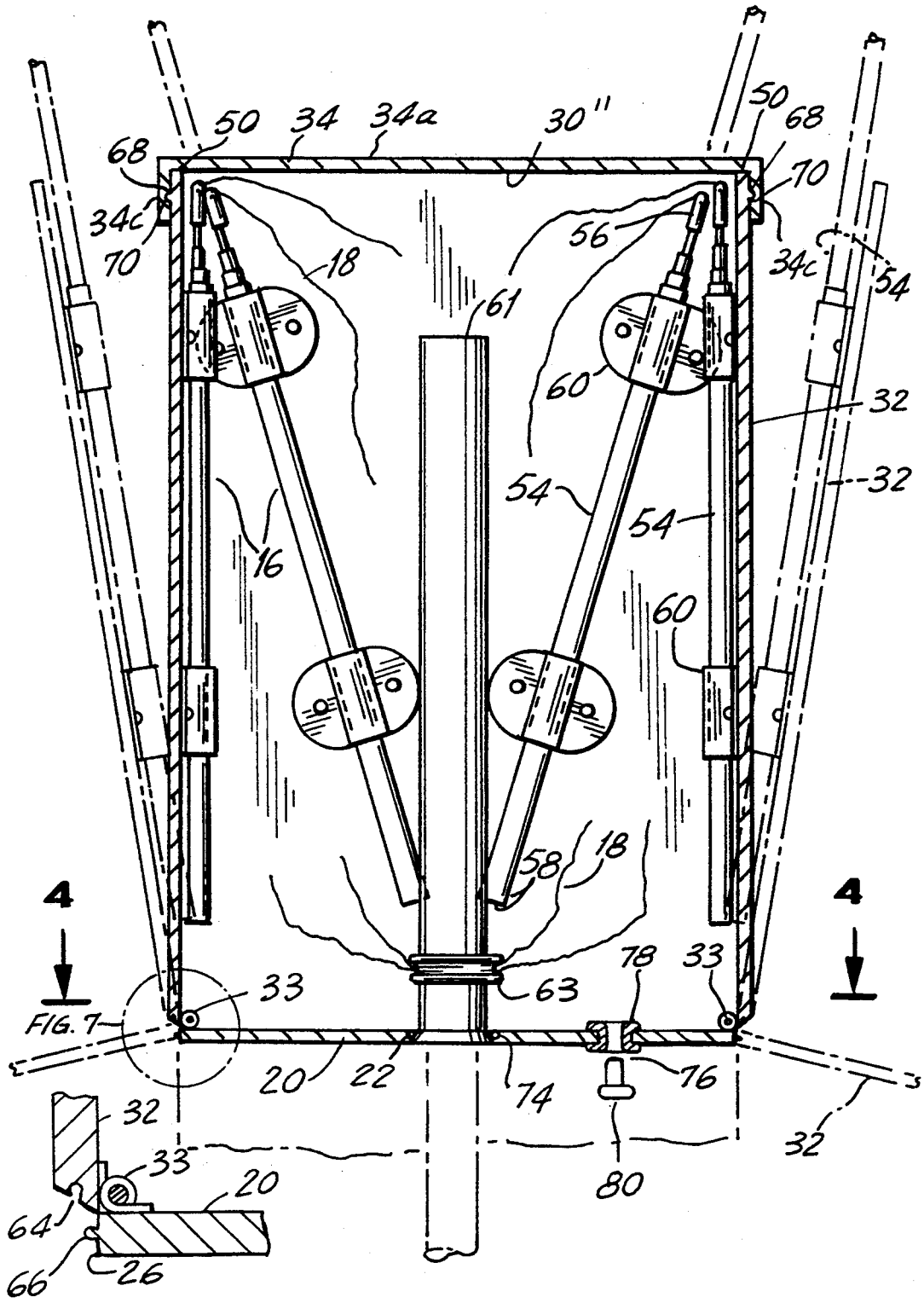
FIG. 2 is a section view along lines 2—2 in FIG. 1, depicting the arrangement of the frame assembly and the canopy in the fully collapsed position within the folding sheath assembly.
FIG. 7 is a detail of the hinged and sealed interface between a panel and the base member of the folding sheath assembly.
Figures 3, 9:
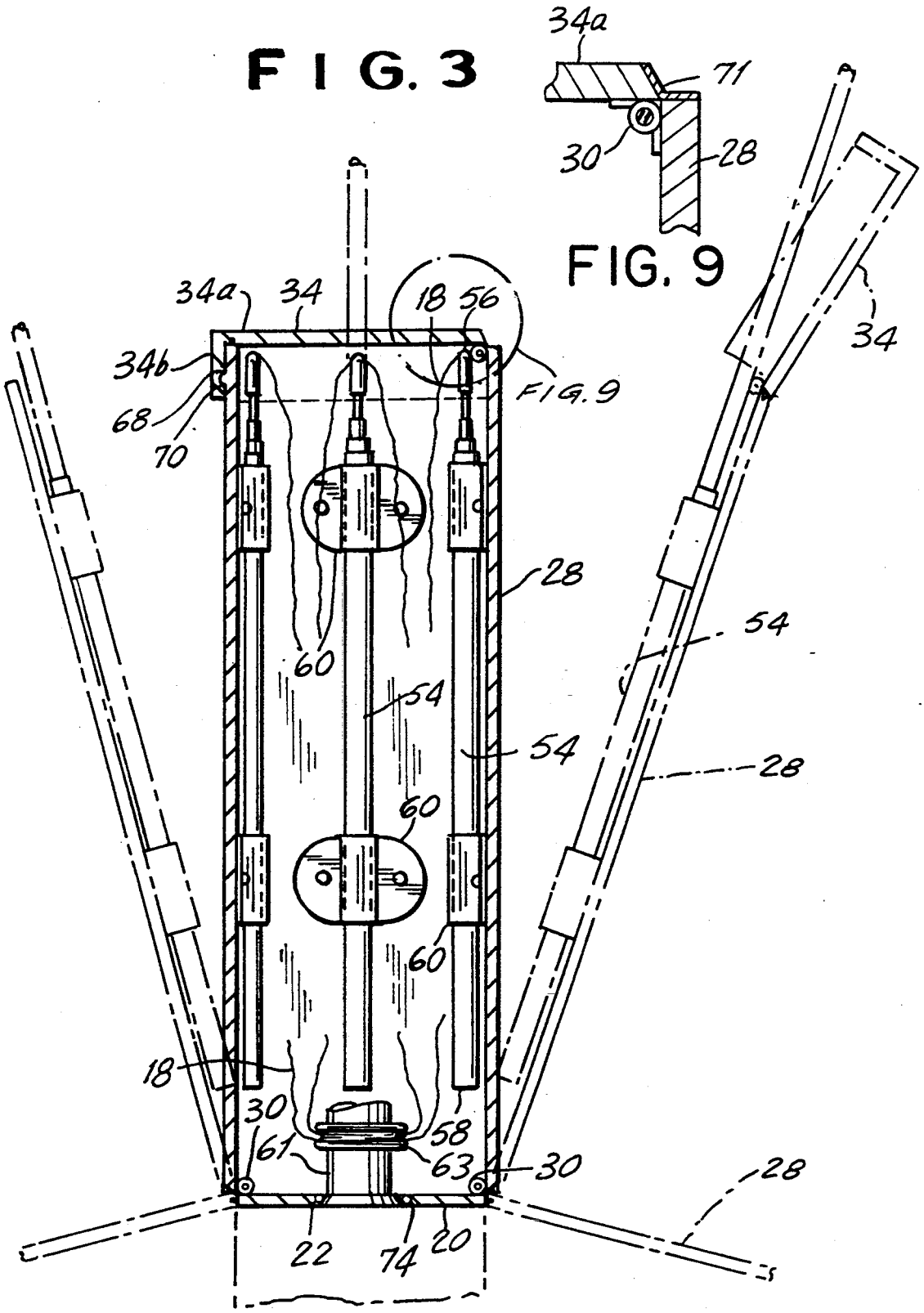
FIG. 3 is a sectional view along lines 3—3 in FIG. 1.
FIG. 9 is a detail of the hinged and sealed interface between the cover portion and a panel of the folding sheath assembly.

Telescoping stick 14 is extendable and collapsible between a use position as shown in FIGS. 5 and 6 and the storage position as shown in FIGS. 2 and 3. Telescoping stick 14 includes a handle portion 72 near one end thereof to facilitate grasping the umbrella in the use orientation. Central core 61 is disposed through aperture 22 in base member 20 with an O-ring or the like 74 and attached thereto by appropriate means to provide a water impervious seal. To store the umbrella 10, the telescoping stick 14 can be fully retracted into central core 61 such that no portion of the stick protrudes beyond the closed panels of the sheath assembly 12 in the storage orientation.

To prepare the umbrella for use, the cover 34 is pulled away and detached from the side panels 28 and 32 and the panels are then pivoted along their hinges with respect to base member 20 until they are angled downwardly as shown in FIGS. 5 and 6. In this position, the panels define the dome of the umbrella. The canopy is unfolded for use by telescopically extending each of the ribs 54 along the full extent of their length to spread umbrella canopy 18 about the frame assembly 16. The telescoping stick 14 is then extended downwardly and the umbrella is ready for use. For storage, the user simply retracts each of the ribs 52 and the telescoping stick 14 into the storage position. The side panels 28 and 32 are then rotated into interlocking engagement with each other and with the base member 20, and the cover 34 is brought into the closed position shown in FIGS. 2 and 3. In this manner, the sheath assembly 12 provides a compact, watertight enclosure for the canopy 18 and frame assembly 16 after use. If desired an optional drain plug 76 can be disposed in any one of the panels 28 or 32, the cover 34 or the base member 20 (by way of example, shown as part of the base member 20), to facilitate draining accumulated moisture. Drain plug 76 comprises a grommet 28 having a hollow bore therethrough and a cap 80 attached to base member 20 with a flexible lanyard or the like.

The present invention has been shown and described in what is considered to be the most practical and preferred embodiment. It is anticipated, however, that departures may be made therefrom and that obvious modifications will occur the person skilled in the art.

I claim:

1. A collapsible umbrella, comprising:

a collapsible radiating frame including a plurality of ribs, each of said ribs having a first and a second end;

an umbrella canopy having a peripheral boundary, said canopy attached near said peripheral boundary to each of said ribs proximal to said respective first ends of said ribs;

a sheath including a plurality of folding panels forming an enclosure in a storage configuration for storing said canopy and said frame therein when said frame is collapsed, said sheath forming an umbrella dome supporting said frame and said canopy when said sheath is unfolded in a use configuration, said frame being attached to said sheath; and a centrally disposed collapsible stick attached to said sheath for carrying said umbrella, said stick collapsible into a storage configuration, and extendable into a use configuration.

2. The collapsible umbrella recited in claim 1, wherein each of said ribs of said frame is telescoping by moving said first end relative to said second end of said respective rib between a storage position and a use position.

3. The collapsible umbrella recited in claim 1, wherein said sheath further comprises a central member and a cover member, and said plurality of panels are hindgedly connected to said central member, and said cover member is hingedly connected to one of said panels, said central member, said panels and said cover member cooperatively forming said enclosure in said storage configuration.

4. The collapsible umbrella recited in claim 3, wherein said panels include cooperating means for interlocking with each other and said cover portion includes means for interlocking with at least one of said panels to make said enclosure watertight in said storage orientation.

5. A collapsible umbrella, comprising:

a collapsible radiating frame including a plurality of telescoping ribs, each of said ribs having a first end movable with respect to a second end of said respective rib between a storage position and a use position;

an umbrella canopy having a peripheral boundary, said canopy attached near said peripheral boundary to each of said ribs proximal to said respective first ends of said ribs;

a folding sheath comprising a central member, a plurality of panels hingedly connected to said central member, and a cover member hingedly connected to one of said panels, said panels, said central member and said cover member cooperatively forming a six-sided enclosure in a storage configuration for storing said canopy and said frame therein, said sheath forming an umbrella dome supporting said frame and said canopy when said sheath is unfolded in a use configuration, said frame being attached to said panels of said sheath; and a centrally disposed telescoping stick attached to said central member of said sheath, said telescoping stick being collapsible into a storage configuration and extendable into a use configuration for carrying said umbrella.

6. The collapsible umbrella recited in claim 5, wherein said panels include cooperating means for interlocking with each other and said cover member includes means for interlocking with at least one of said panels to make said enclosure watertight when said sheath is in said storage configuration.

7. A collapsible umbrella, comprising:

a collapsible radiating frame including a plurality of telescoping ribs, each of said ribs having a first end movable with respect to a second end of said respective rib between a storage position and a use position;

an umbrella canopy having a peripheral boundary, said canopy attached near said peripheral boundary to each of said ribs proximal to said respective first ends thereof;

a folding sheath comprising a central member, a plurality of panels hingedly connected to said central member and a cover member hingedly connected to one of said panels, each of said panels having an inner surface and an outer surface, and having at least one of said ribs attached to said inner surface such that said second end of said rib is fixed relative to said panel, said panels, said base member and said cover member cooperatively forming a watertight enclosure for storing said canopy and said ribs therein when said sheath is folded into a storage configuration and said ribs are collapsed by moving said first ends of said ribs towards said second ends of said ribs, and forming an umbrella dome when said sheath is unfolded into a use configuration for supporting said ribs and said canopy when said ribs are extended by moving said first ends of said ribs away from said second ends of said ribs; and a centrally disposed telescoping stick attached to said central member of said sheath for carrying said umbrella, said telescoping stick being extendable and collapsible between a storage configuration and a use configuration.

* * * * *